United States Patent [19]

Yon

[11] 4,416,200

[45] Nov. 22, 1983

[54] PAPER FEED MECHANISM FOR ROTARY DIE CUTTER

[75] Inventor: William S. Yon, Hartsville, S.C.

[73] Assignee: Sonoco Products Company, Hartsville, S.C.

[21] Appl. No.: 428,152

[22] Filed: Sep. 29, 1982

[51] Int. Cl.[3] ..... B41F 13/04

[52] U.S. Cl. ..... 101/228; 226/143; 83/74

[58] Field of Search ..... 101/237, 226, 222, 223, 101/224, 216, 228, 253, 153; 226/8, 115, 143; 83/74, 75, 312, 313

[56] References Cited

U.S. PATENT DOCUMENTS

| | | | |
|---|---|---|---|
| 501,603 | 7/1893 | Honiss | 101/228 |
| 1,489,167 | 4/1924 | Spiess | 101/228 |
| 2,845,021 | 7/1958 | Pincuert et al. | 101/228 |
| 3,244,095 | 4/1966 | Matthew | 101/94 |
| 3,548,747 | 12/1970 | D'Amato | 101/228 X |
| 3,610,147 | 10/1971 | Crissy | 101/228 |
| 3,756,149 | 9/1973 | Bishop et al. | 101/228 |
| 3,963,160 | 6/1976 | Bishop | 226/115 |
| 4,066,016 | 1/1978 | Tison | 101/253 X |
| 4,147,078 | 4/1979 | Bishop | 83/74 |
| 4,153,191 | 5/1979 | Bishop | 226/143 |

OTHER PUBLICATIONS

"Variable Cutlength Rotary Die Press", Leaflet No. 774, *Deritend Engineering Co.,* Aug. 1980.

*Primary Examiner*—E. H. Eickholt

*Attorney, Agent, or Firm*—Dennison, Meserole, Pollack & Scheiner

[57] ABSTRACT

In die cutting the impression roll is maintained at constant peripheral velocity and the web, while engaged by the die, travels at the peripheral velocity of the impression roll. As the trailing edge of the die approaches the nip formed by the impression and complementary rolls, one or both of the feed rolls driven by the web is clutched into a cam mechanism for positive driving at a constant velocity equal to the die-induced velocity of the web. This constant velocity driving of the web jointly by the die and feed rolls continues until the die releases the web beyond the aligned centers of the treatment rolls when the web comes under exclusive control of the feed rolls. The cam-controlled velocity of the feed rolls and web then decreases to zero, is maintained at zero velocity for a period of time dependent upon the peripheral distance between the die trailing edge and die leading edge, and is then driven in a reverse direction for a fixed distance and accelerated forward to the peripheral velocity of the impression roll at which point, during the constant velocity motion of the feed rolls as induced by the cam mechanism, the leading edge of the die engages the web at the exact point of disengagement of the trailing edge of the die on the previous cycle. While still in the constant velocity portion of the feed roll drive cycle, the clutch is disengaged and the feed rolls freed for web induced travel, the web itself now being driven by the die engaged therewith.

6 Claims, 20 Drawing Figures

PAPER FEED MECHANISM FOR ROTARY DIE CUTTER

BACKGROUND OF THE INVENTION

The invention herein is generally concerned with the feeding of web material to high speed rotary treatment apparatus, particularly die cutting apparatus and the like. More specifically, the invention is concerned with a system for the elimination of web material waste between successive blanks treated or cut from the web. The minimization of this waste has long been a goal, with a particularly efficient system set forth in U.S. Pat. No. 3,756,149, issued on Sept. 4, 1973 to Thomas Bishop.

The Bishop apparatus, through cam controlled feed rolls and uniform acceleration, in both a forward and reverse direction, achieves a pullback of the web material during those periods of disengagement by the treatment means or die. While the web control achieved by Bishop U.S. Pat. No. 3,756,149 is significant and results in a substantial reduction in waste in a structurally simple and efficient manner, the Bishop apparatus does not provide for a complete elimination of waste between impressions of the trailing edge of the die and the subsequently encountered leading edge thereof.

The complete elimination of waste, aside from the obvious economic advantages, becomes particularly significant when producing blanks with an interrupted or two-pass cut. This requires extreme accuracy in aligning the leading edge of a cut with the previously formed trailing edge to produce a blank without distortion or variation in length.

Bishop, U.S. Pat. No. 3,756,149, is not capable of providing the accuracy required for a proper interrupted cut. This is primarily because of the lack of any provision, in Bishop, for the accommodation of the overfeeding of the web occurring in general both during the initial engagement of the die with the web and at the point of disengagement therefrom. Basically, due to the thickness of the web material and the penetration of the die rule into the complementary roll, the leading cutting edge of the die will normally engage the web material and effect a positive forward driving thereof prior to the aligned centers of the rolls. This engagement continues with the trailing edge of the die remaining in driving contact with the web material a distance beyond the centerlines. This in turn results in an excess positive forward feed of the web material by a length equal to the sum of these two distances. Bishop, U.S. Pat. No. 3,756,149, while providing for a deceleration, stopping and reversing of the web after the trailing edge of the die has left the nip, then proceeds to position the trailing end of the blank on the web at the nip or slightly beyond the nip when the leading edge of the die reenters the nip. Thus, there is no recognition of the problem of die engagement prior to the aligned roll centerline and disengagement subsequent thereto. As such, an inherent amount of waste material is retained.

In a further attempt to reduce or eliminate waste between cut or printed blanks, and without an indication of recognition of the inherent problems of pre-engagement and post disengagement of the die with the web, Bishop, in U.S. Pat. Nos. 4,147,078 and 4,153,191, proposes rather elaborate systems, including multiple sets of feed roll pairs and photoelectric sensing and control systems.

SUMMARY OF THE INVENTION

It is a primary purpose of the present invention to provide a system which simply although uniquely advances the teaching in Bishop U.S. Pat. No. 3,756,149, to effect a complete elimination of waste created by die or forme interruption. In conjunction therewith, is the ability to produce blanks with an interrupted or two-pass cut, the accuracy being such that the leading edge of a blank can be cut with the trailing portion of the die and the trailing edge of the blank with the leading edge of the die on the next pass. Bishop U.S. Pat. No. 3,756,149 is incapable of producing an interrupted cut to an accuracy greater than its inherent overfeed at the leading and trailing edges of the die.

In accordance with the system of the invention, specific recognition is made of the web overfeed inherent in the utilization of a penetrating die or compliant printing mat, a cushioned complementary roll, and the thickness of the paperboard web material. There is also a recognition of the necessity for specifically accommodating this overfeed in the "net pullback" if zero waste is to be achieved. (The term "net pullback" as used herein is defined as the resultant reverse displacement of the web, the amount by which the reverse displacement of the web exceeds the sum of the forward displacements of the web, during the interval when the web is free of the treatment means.) This is effected by a cam controlled sequence of operations wherein the web-engaged feed rolls, through an engaged clutch, are forwardly driven at a constant velocity equal to that of the web traveling in response to the rotating die engaged therewith. At the point of die release of the web, beyond the nip, the feed rolls, with the web carried thereby, decelerate to zero velocity and remains at zero velocity for a period determined by the distance between the two feed roll controlling cams, this distance set in accord with the peripheral distance between the trailing edge of the die and the leading edge of the die on the next pass. The feed rolls are then accelerated in a reverse direction to a velocity equal to and opposite that of the impression roll or normal forward die induced velocity of the web. At this point, the feed rolls, and web driven thereby, are at a reverse velocity for a web length corresponding to the overfeed resulting from the early engagement of the die leading edge and the point of effective operation of the trailing edge, both relative to the aligned centerlines of the treatment rolls. This is followed by a decrease to zero velocity and a subsequent increase, in the forward direction, to a velocity equivalent to that of the die driven web. This velocity is achieved at or before the time the leading edge of the die engages the web prior to the aligned centerlines at exactly the point of previous disengagement of the trailing edge of the die, thus producing zero waste. The positive drive of the feed rolls is maintained at a constant velocity equal to the velocity of the die driven web for a length during which time the clutch is disengaged and the feed rolls released from driving engagement with the cam controlled means.

The above system provides for a complete elimination of waste between the trailing edge of a die and the leading edge of the die at the subsequent pass thereof. This results in not only a substantial saving of material, but also provides for a two-cut or interrupted cut blank formation.

DESCRIPTION OF PREFERRED EMBODIMENT

Figure 1:
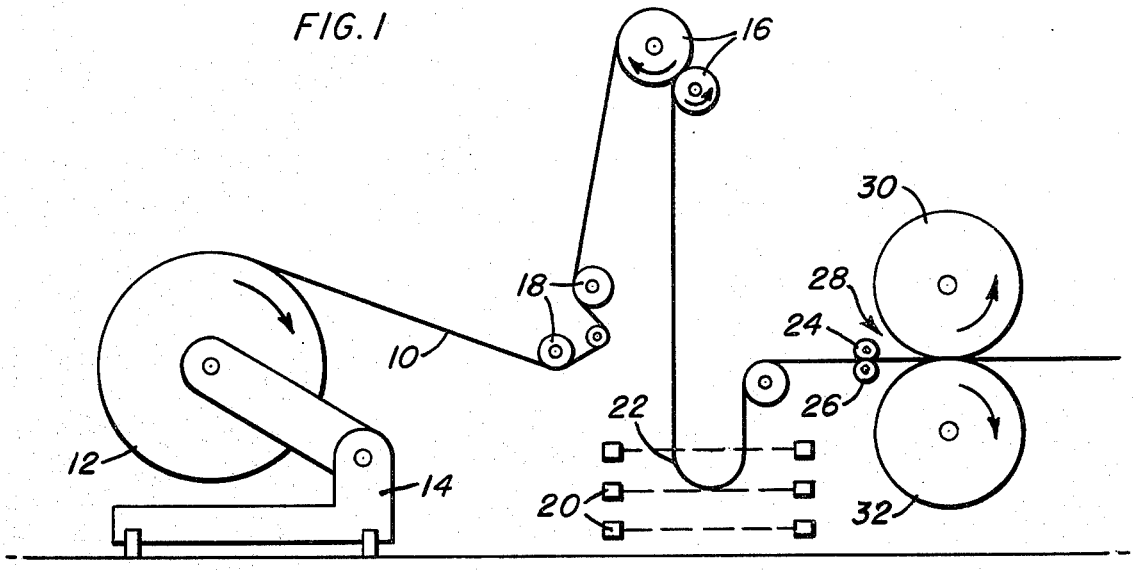
FIG. 1 is a schematic illustration of a die cutter line of a type which will incorporate the features of the present invention.

In the FIG. 1 schematic illustration, the web or web material 10 is pulled from a roll 12, mounted on an roll stand 14, under tension by appropriately driven pull rolls 16. The web is pulled through a decurl section 18 for removal of the curl. The driving of the pull rolls 16 is controlled by photocells 20 in a manner whereby a slack loop 22 is maintained in the web beyond the pull rolls. The web 10 is drawn from the slack loop 22 through upper and lower feed rolls 24 and 26 with the web 10 subsequently being supplied to the high speed rotary die cutter 28 comprising an upper impression or die carrying roll 30 and a lower anvil or roll 32, either rigid or cushioned.

The web movement through the rotary cutter is effected by the direct pull thereon by the die and is, throughout the period of engagement by the die, maintained at a velocity equal to the constant peripheral velocity of the die. Generally, the part or blank to be cut is not of a length exactly equal to the circumference of the die roll 30 measured at the die rule edge. Therefore, there will be a gap in the die during which no web material is pulled. This can be appreciated from the schematic views of FIGS. 2 and 3 wherein the die, on the impression roll 30, has been designated by referece numeral 34.

Figure 2:
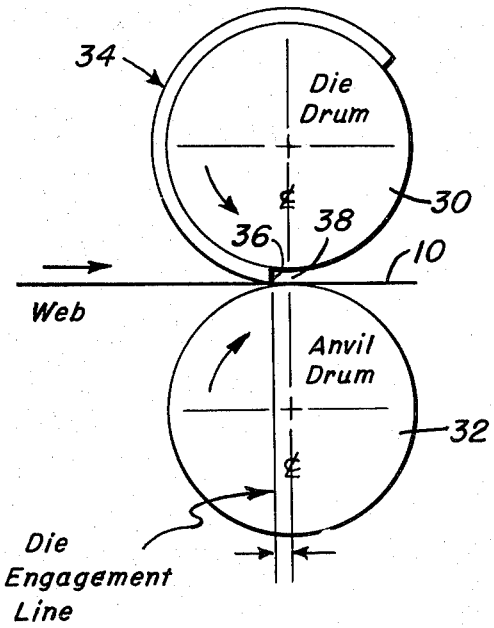
FIG. 2 is a schematic illustration of the treatment rolls as the leading edge of the die comes into driving contact with the web prior to the aligned centerlines of the rolls.
Figure 3:
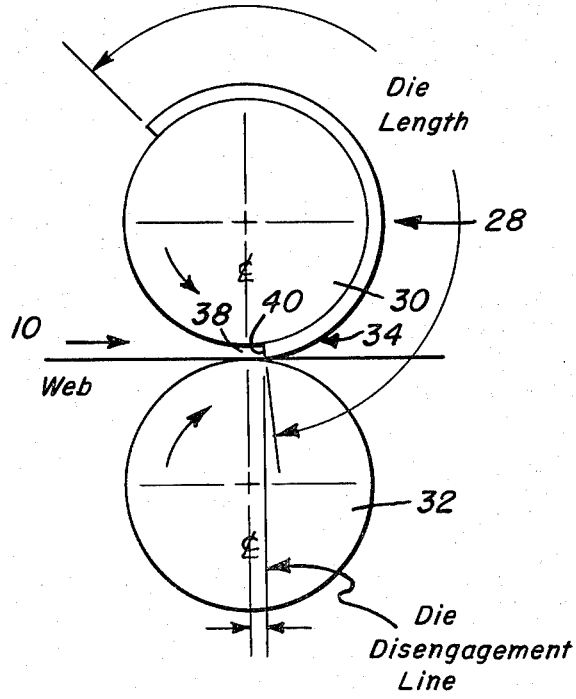
FIG. 3 is a view similar to FIG. 2 at the point which the trailing end of the die disengages from the web beyond the aligned centerlines of the rolls.
Figure 4:
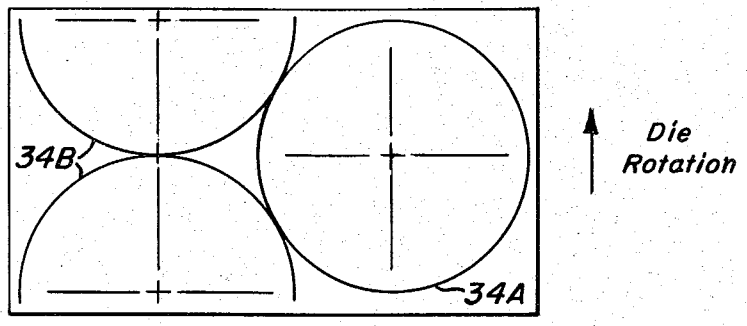
FIG. 4 is a schematic illustration of a compact die arrangement wherein a complete blank die is combined with two interrupted cut dies.

As will also be noted from FIGS. 2 and 3, the die 34, for a variety of reasons including web thickness, penetration of the die into the cushioned surface of the anvil roll, etc., starts pulling the web 10 before the leading edge 36 of the die reaches the cutter center line 38 and continues to pull the web material 10 until the trailing edge 40 of the die disengages the web material 10 past the center line 38. This centerline 38 is coincident with the aligned centerlines of the rolls 30 and 32. On a die which cuts a complete blank in a single pass, this means that scrap is generated between blanks. On a die which cuts the leading edge of the blank on one revolution and the trailing edge on the next revolution, as is frequently desired to maximize the blanks cut, this results in a blank which is too long or otherwise distorted. FIG. 4 illustrates a development drawing of a convenient die arrangement combining a die 34A which cuts a complete blank with dies 34B which respectively cut the leading and trailing portions of a blank on sequential revolutions of the roll. By combining the dies in this manner two patterns can be obtained within a web width substantially less than the combined transverse lengths or diameters of two blanks.

The problem of the generation of waste between the die trailing and leading edges is unavoidable on rotary cutters of the type herein described. The scrap generated can be in the neighborhood of two to three inches long depending upon paper thickness, and die penetration. This is quite significant.

Figure 5:
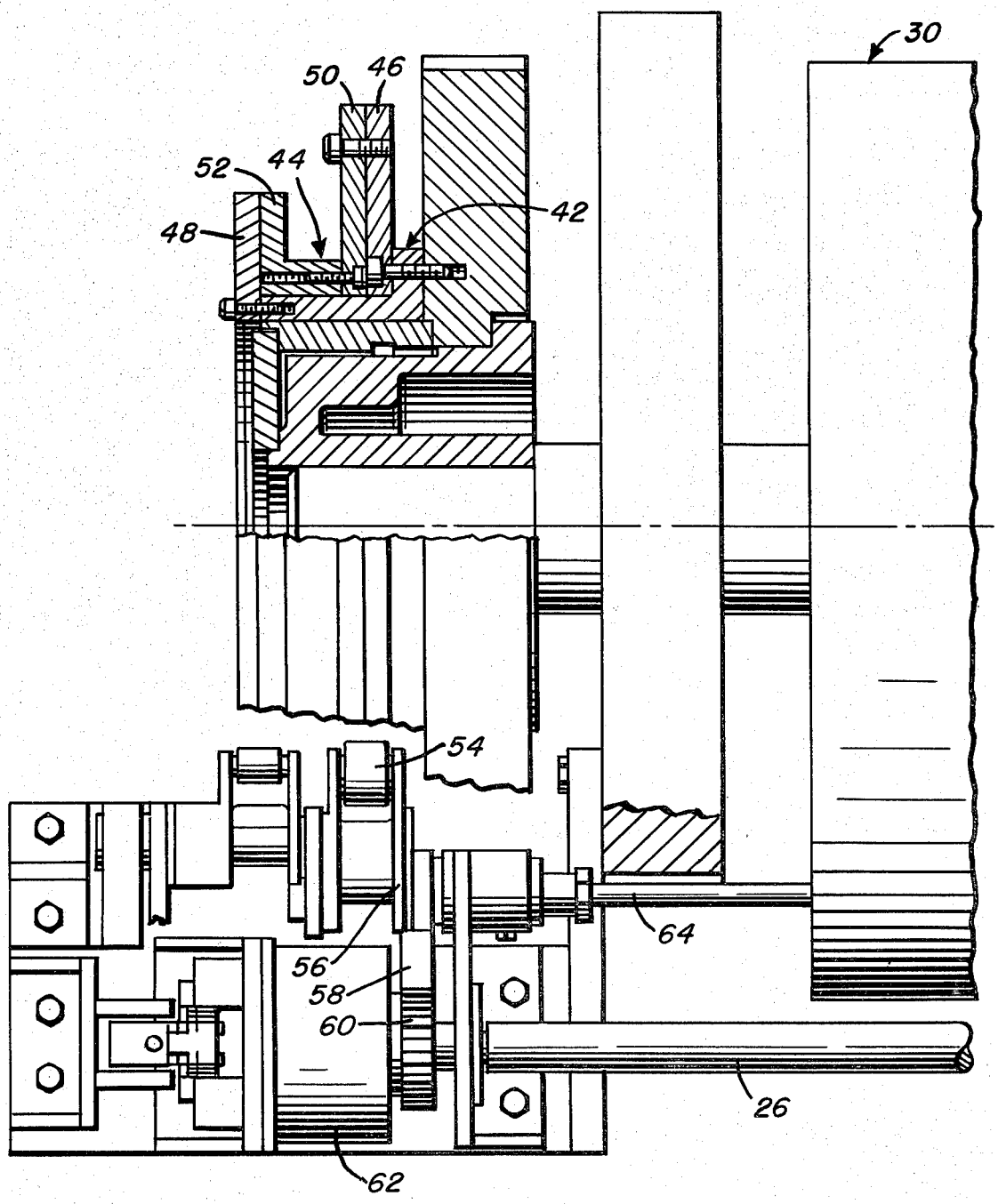
FIGS. 5 through 7 generally schematically illustrate portions of an apparatus by which control of the web feed is achieved.
Figure 6:
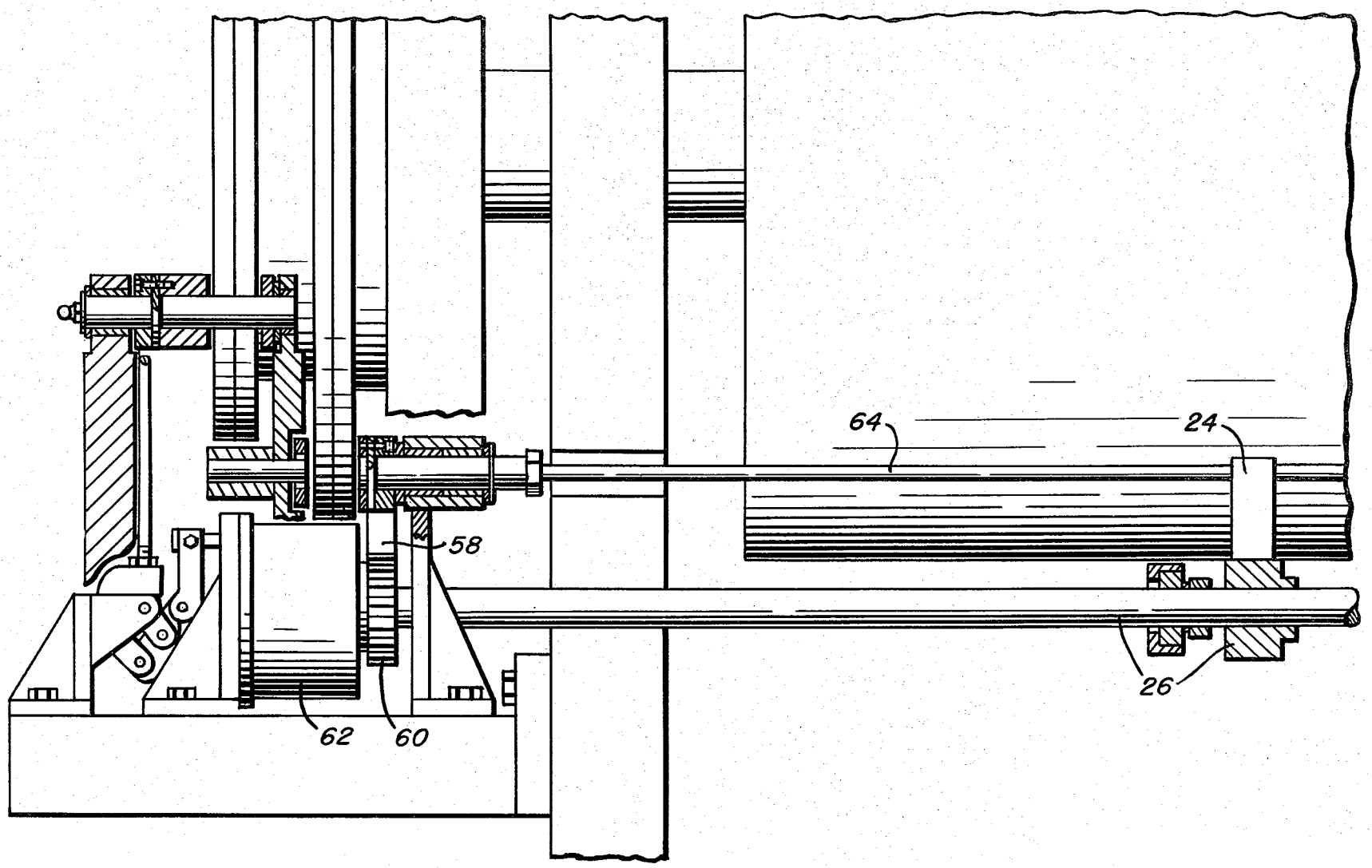
Figure 7:
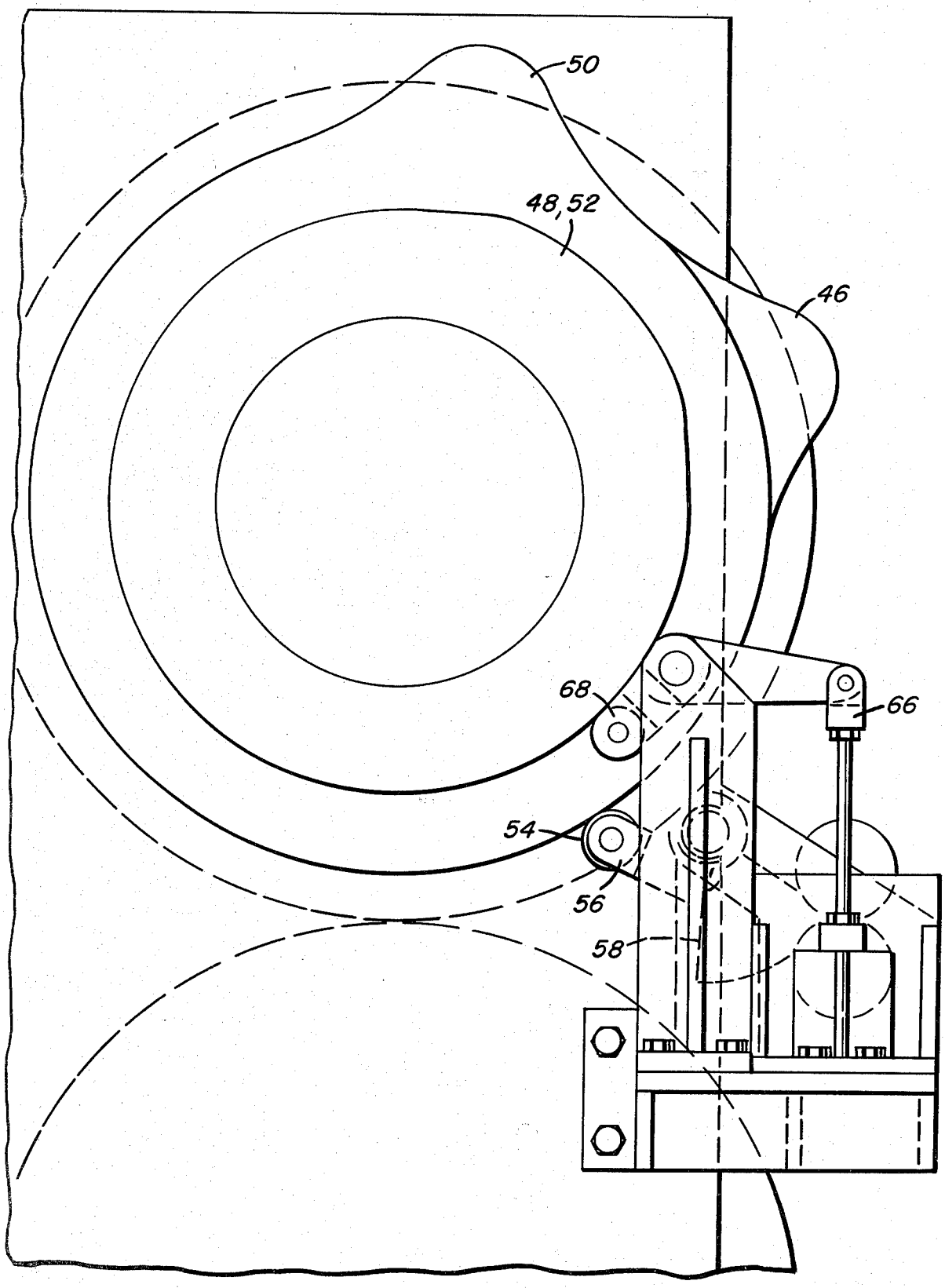

Bishop, U.S. Pat. No. 3,756,149 proposes a reduction of the waste or scrap generated by pulling the web back while the gap in the die is passing through the nip area, that is while the die is not engaged with the web. However, the Bishop proposal has been found to be less than satisfactory in that no provision is made for the accommodation of the inherent overfeed generated by the engagement of the leading edge prior to the roll centerline and the disengagement of the trailing edge beyond the centerline. As such, not only is excess scrap generated, but the ability to produce two-pass cuts is precluded. This problem is completely avoided in the present invention, the system of which provides for an exact positioning of the leading edge of the die with the cut provided by the trailing edge thereof on the prior revolution. While the system of the invention is capable of accommodating control means of different types, FIGS. 5, 6 and 7 generally schematically illustrate one form of apparatus, presently preferred, by which the exact control of the web feed is achieved. The impression or die roll 30 carries a hub 42. The cam hub 42 is adjustably secured to the impression roll 30 and mounts a trailing edge feed cam 46 and a laterally spaced clutch cam 48 in fixed relation thereto. The second cam assembly 44 is adjustably mounted on the first hub 42 for a selective fixing thereof in an adjusted position relative to the hub 42. The second cam assembly 44 similarly includes a leading edge feed cam 50 and a laterally spaced clutch cam 52 in fixed relation thereto.

A cam follower 54 is operatively positioned in the path of rotation of the feed cams 46 and 50, and is carried by one end of a pivotally mounted cam follower arm 56, the other end of which mounts a sector shaped rack or gear 58 which is in continuous meshed driving engagement with the clutch input gear 60 of the clutch assembly 62. A torsion spring 64 preloads the cam follower 54 against the feed cams and serves to maintain the follower in contact with the cam. The sector gear 58, and hence the clutch input gear 60, are selectively driven in opposite directions, corresponding to a forward drive of the feed roll or rolls and a reverse drive thereof, in response to cam induced movment of the follower.

The rotational driving of the input gear is translated into a driving of the lower feed roll 26 through an engagement of the clutch assembly 62 effected through a follower controlled linkage 66, the follower 68 of which is positioned for operational engagement by the adjacent traveling clutch cams 48 and 52. If necessary, both feed rolls can be driven. Further, more than one set of feed rolls can be utilized. The feed rolls are at all times engaged with the web and either traveling in response to die induced movment of the web, or effecting a positive driving of the web depending on whether the clutch is disengaged or engaged. The feed rolls do not disengage from the web.

One feed cam and clutch cam pair is associated with the leading edge of the die and the other pair with the trailing edge. The cam pairs are adjustable relative to each other and relative to the die with the clutch cam of each pair fixed to the feed cam for maintaining a specific clutch operating relationship regardless of the adjustment between the feed cams as dictated by the die length.

Figure 8:
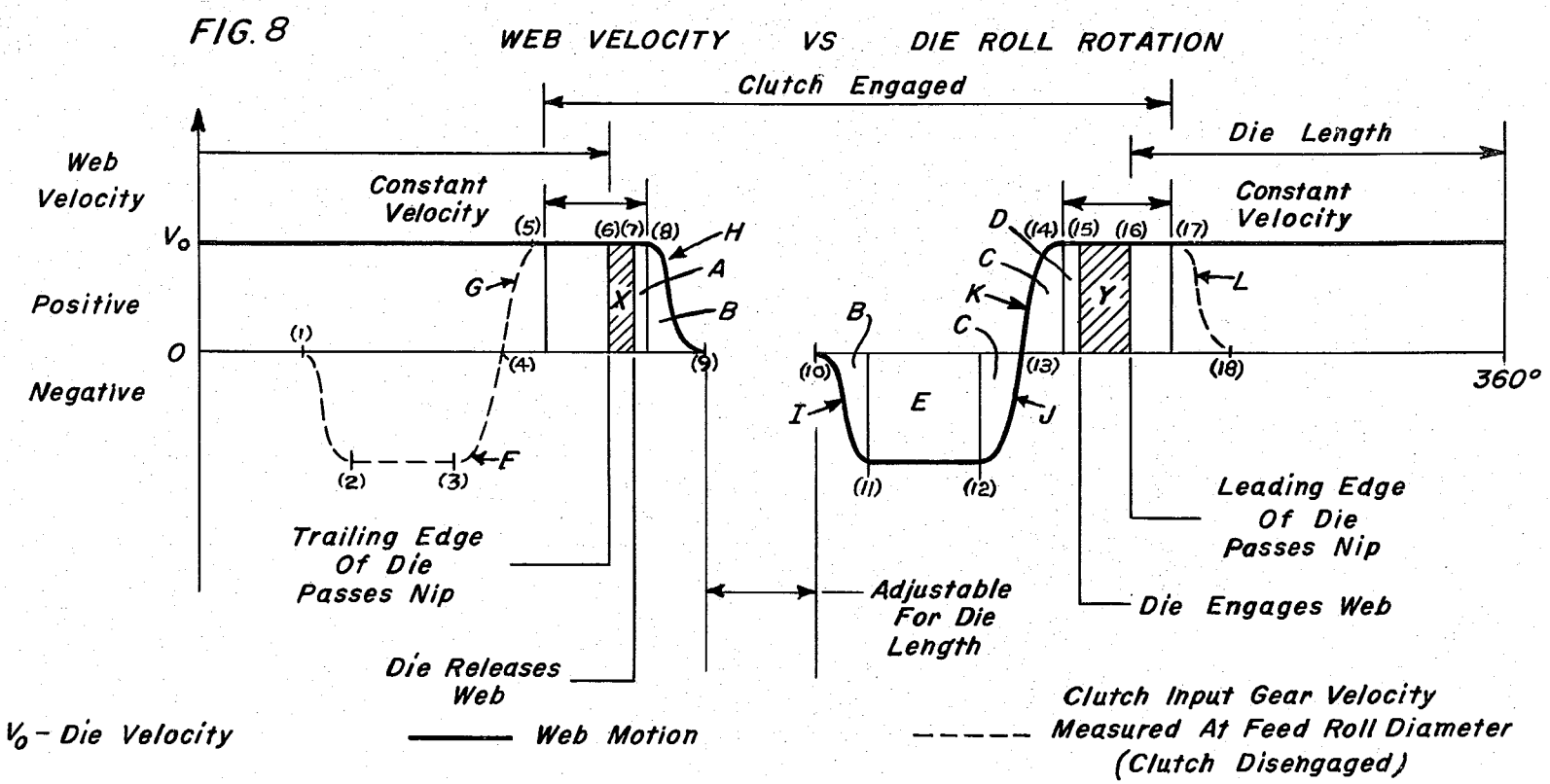
FIG. 8 graphically illustrates a complete operating cycle of the system of the invention.

Reference is now made to FIG. 8, the velocity diagram of the web and feed rolls wherein one complete operating cycle of the apparatus is illustrated. The horizontal axis marked 0° to 360° represents one complete revolution of the impression roll. 0° is arbitrarily selected as being some point at which the web is being exclusively driven by the die at die peripheral velocity. Beginning at point (1) the clutch input gear (60, FIG. 7) is driven through a reverse direction motion by the feed cam associated with the trailing edge of the die and accelerated to a forward angular velocity equal to the web induced feed roll angular velocity all the while being declutched from the feed roll. Upon attaining the angular velocity of the web driven feed roll (5) the velocity of the clutch input gear is maintained constant and the clutch engaged to effect a positive drive of the feed rolls. Inasmuch as the feed rolls are traveling at a constant velocity in response to web motion at the time, the clutch engagement and the commencement of positive drive of the feed rolls is effected without slippage which could disturb the web or cause wear of the clutch. The trailing edge feed cam is adjusted with respect to the die so that the trailing edge of the die comes into alignment with the aligned centers of the treatment rolls (hereinafter called the "nip") at some time (6) after the clutch is engaged. Sufficient length of constant velocity duration must be provided on the cam profile such that the actual die release (7) occurs during the constant velocity portion of the cycle. The web after this point is under the exclusive control of the cam-driven feed rolls and will remain so until after the die again engages the web in the next pass of the die. The area under the positive portion of the web velocity curve and above the zero velocity axis equals the forward web displacement. Likewise, area lying between the negative portion of the web velocity curve and the zero velocity axis equals reverse web displacement. The area X, occurring between (6) and (7), is the overfeed caused by the post disengagement of the die from the web after the trailing edge of the die has passed through the nip. Further forward web travel is incurred as the feed rolls drive the web a further distance, A, at constant velocity and a distance, B, as the web is decelerated to zero velocity. After a period at rest which is related to the circumferential distance between the the trailing and leading edges of the die and which is adjustable for different die lengths, the cam which is associated with and adjustable with respect to the leading edge of the die resumes the motion of the web.

As the leading edge of the die approaches the nip, the leading edge feed cam comes into contact with the sector gear cam follower and causes a reverse motion of the clutch input gear and web followed by a forward motion. These motions are identical to those caused by the trailing edge cam and which have been previously described except that the clutch remains engaged for the duration of the reverse motion and a portion of the forward motion driving the feed rolls and therefore the web in reverse and then forward. At some time after the feed rolls and web have achieved constant velocity at die speed (14) the die engages the web (15) and the leading edge of the die passes the nip (16) a distance Y later still during the constant velocity phase, Y being the overfeed caused by preengagement of the leading edge of the die. At the end of the constant velocity phase the clutch is disengaged (17) and drive of the web is again under exclusive control of the die. The cam decelerates the clutch input gear to zero velocity (18) where it remains until the trailing edge of the die again approaches the nip and a new cycle begins. In one embodiment of the invention the reverse portion of the cam is the inverse of the forward portion so that the components of the area between the reverse velocity curve and the zero velocity axis are respectively equal to the corresponding areas of the portions under the positive velocity curve. More specifically, portions of the areas designated as B of the negative and positive curves are equal and the areas marked C are likewise equal and therefore cancel each other. Since it is a primary requirement for the system to feed forward in one cycle a length of web exactly equal to one die length for no scrap to be produced, the positive area lying under the positive portions of the web velocity curve and above the zero velocity axis which corresponds to web fed forward under the influence of the die and the feed rolls combined minus the negative area lying between the negative velocity curve and the zero velocity axis corresponding to the length of web pulled back under the exclusive control of the feed rolls must exactly equal the length of web contained in one die length. As long as the remaining negative area designated E is as large as the combined overfeed areas X plus Y the mechanism is capable of producing blanks with zero scrap in between. In practice, the negative area E is made larger than X+Y so that the end of the first positive constant velocity portion (8) and the beginning of the second constant velocity portion (14) need not be exactly aligned with the die disengagement and engagement points (7) and (15) respectively. Thus an additional positive feed equal to the combined areas A and D are canceled by E. The provision of extra reverse motion relaxes the precision required in cam adjustment and accommodates minor variations in overfeed represented by X and Y due to variations in web thickness, wear of the complementary roll, and variations in penetration of the die into the complementary roll.

Symmetrical cams have been shown and referred to for simplicity. However, the positive and negative velocity curves may differ as long as the forward and reverse displacements are equal. As an example, in accommodating longer dies, the system may utilize a reverse direction velocity profile which does not provide a constant velocity portion but which does contain the same total area as the positive profile. Further, while there will generally be an overfeed associated with the trailing edge, in some situations the web my be severed by the time the trailing edge passes the centerline, or even before, given extra die rule penetrations. Thus, there may actually be a zero or slightly negative underfeed associated with the trailing edge of the die. For purposes of illustration, the treatment applied by the treatment rolls has been referred to as die cutting whereas other treatment means, such as printing or embossing, applied over less than the full periphery of the fixed diameter treatment roll may also be the subject of the invention provided that they effect a positive drive on the web while engaged with the web or will permit driving means to be used to effect a positive drive of the web during engagement of said treatment means with the web.

The amount of overfeed X and Y will vary among treatment means and even within a particular treatment means according to the shape of the blank being treated. These amounts of overfeed should not be considered fixed or even equal to each other and this variation must be accommodated by cam adjustments provided relative to the leading and trailing edges of the treatment means so that overfeeding occurs during the positive constant velocity portions of the cam induced feed roll motion.

Figure 9:
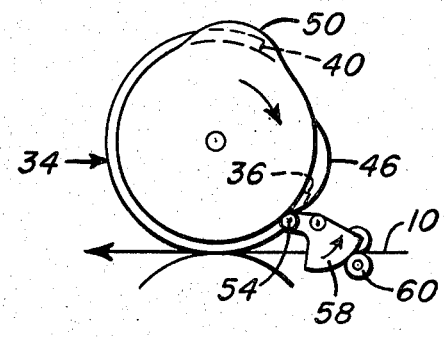
FIGS. 9 through 20 schematically illustrate the operative arrangement of the component parts of the apparatus during the cycle of FIG. 8.
Figure 10:
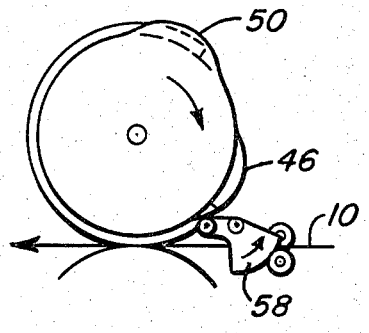
Figure 11:
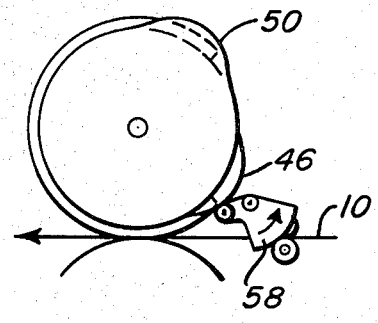
Figure 12:
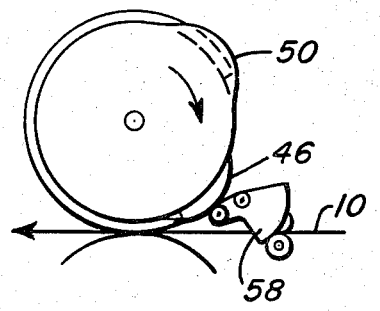

The operative arrangement of the component parts during the complete cycle of FIG. 8 are illustrated in FIGS. 9–20. In FIG. 9, the feed cam 46 associated with the trailing edge of the die has initially engaged the sector gear cam follower 54. This corresponds with point (1) on the velocity diagram of FIG. 8 and occurs while the web 10 is being driven at a constant velocity by the die 34. The clutch, at this stage, is disengaged, hence the clutch input manipulation is effected independently of the drive feed roll motion, which is maintained at the constant forward velocity of the web in continuous engagement therewith. The movement of the sector, and associated clutch input gear 60, sequentially moving through the positions from FIGS. 9 to 12 and graphically illustrated as points (1) to (4) in FIG. 8, initially accelerates in a reverse direction, as illustrated by graph line F. This is effected through engagement of the follower with the ascent side of the feed cam associated with the trailing edge of the die immediately above the base. Upon achievement of maximum reverse angular velocity of the sector, equal and opposite to that induced into the feed rolls by the traveling web, the follower engages along a constant velocity intermediate portion of the ascent side of the cam, as indicated in FIGS. 10 and 11 and between points (2) and (3) of FIG. 8. The sector, along with the clutch input gear, continues in a reverse direction as the follower moves from the constant velocity cam section on the ascent side of the cam to the cam apex, at which time the sector velocity, and that of the associated clutch input gear, is zero. This point is illustrated in FIG. 12 and at point (4) of FIG. 8.

Point (4) on the velocity diagram corresponds to the point of zero velocity and sector movement reversal with the sector, as the follower commences movement down the descent side of the cam, accelerating forwardly, as shown by line G, to a velocity corresponding to the velocity of the feed rolls as induced by the traveling web. This corresponds to point (5) on the velocity diagram with the components operably positioned as in FIG. 13. At this point of equal velocity, the clutch is engaged for a positive feed roll driving of the web in conjunction with the die induced movement thereof. This occurs as the trailing edge of the die approaches the centerline of the cutter rolls.

Figure 13:
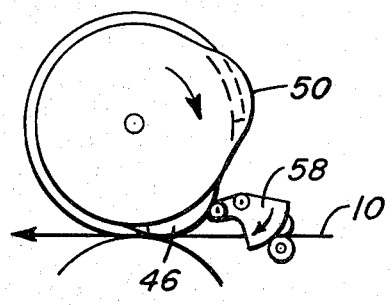
Figure 14:
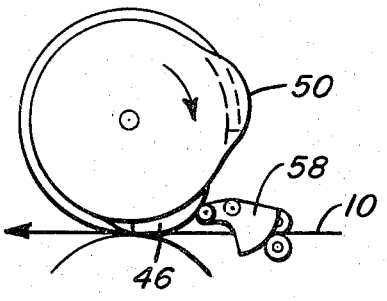

The descent side of the cam is configured, along an intermediate portion thereof immediately beyond the acceleration portion corresponding to line G in FIG. 8, with a constant velocity portion, designated between points (5) and (8) on the velocity diagram and the positional illustrations of FIGS. 13 and 14. Point (7), as shown in the positional illustration of FIG. 14, corresponds to the point at which the die releases the web. This is a point beyond the cutter rolls centerline resulting from a combination of factors including the thickness of the web, the depth of penetration of the die into the backup roll, and the like. It is, in part, to compensate for this delayed die disengagement, as well as a corresponding pre-engagement of die prior to the actual severing operation, that the present invention provides.

Subsequent to the release of the web by the die, the web is driven solely by the feed rolls which in turn, through the engaged clutch, are driven by the cam controlled sector.

Figure 15:
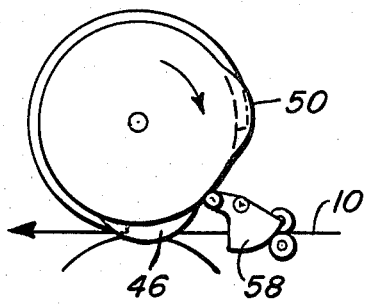

The clockwise movement of the sector, and hence the forward movement of the feed rolls and feeding of the web, decelerates, line H, as the follower traverses the lower portion of the descent side of the cam 46 to the point of disengagement therewith, point (9) in the FIG. 8 diagram and the positional arrangement of FIG. 15. This corresponds to a point of zero velocity for the sector, feed rolls and web. This zero velocity interval is dependent upon the extent of the die length and corresponds to the distance between the controlling first and second cams. This distance is adjustable, in accord with the length of the die.

Figure 16:
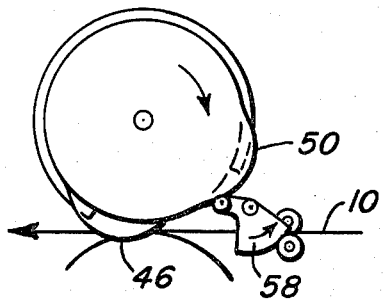
Figure 17:
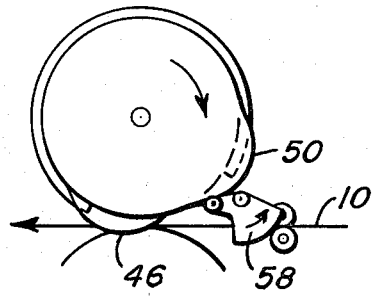
Figure 18:
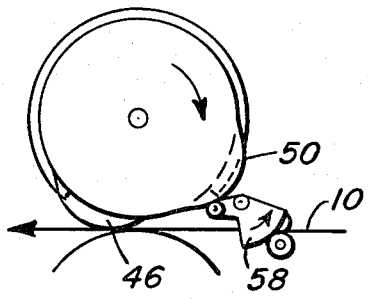
Figure 19:
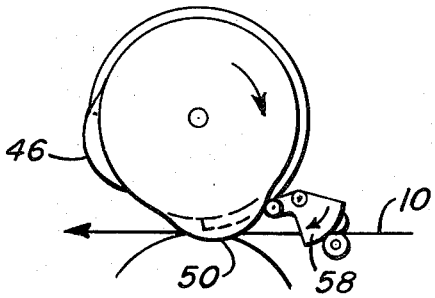
Figure 20:
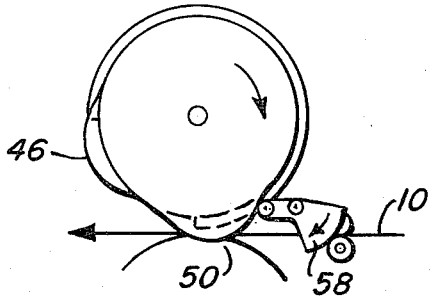

At the position of FIG. 16, corresponding to point (10) of FIG. 8, the follower engages the second cam 50 and, through movement up the ascent side thereof from the zero velocity position, accelerates the sector and, through the engaged clutch, the feed rolls in a reverse direction. This acceleration in a reverse direction is designated by line I and between points (10) and (11). Upon achieving a reverse velocity for the feed rolls and web driven thereby equal to the normal forward die-induced web velocity, the second cam 50, along an intermediate portion of the ascent side thereof noting FIGS. 17 and 18 and positions (11) and (12) of FIG. 8, provides for a constant reverse velocity for a period of web length corresponding to at least the sum of the excess forwardly fed web induced by and corresponding to the release of the web by the die beyond the aligned centerlines of the cutter rolls, and the die engagement and driving of the web prior to the centerlines by the leading edge of the die.

This constant velocity displacement E, is followed by a continued reverse movement of the sector and feed rolls at a decelerating rate designated by line J in the velocity diagram. The sector, as the follower moves over the apex of the second cam, passes through a point of zero velocity, (13) on the diagram, and accelerates in a forward direction, indicated by line K, to bring the sector, feed rolls and web up to the velocity of the die roll. At this point, (14), noting FIG. 19, the leading edge 40 of the die 34 comes into driving engagement with the web prior to the rolls centerline. The web acceleration in the forward direction, as designated by line K, complements the reversely directed deceleration designated by line J. At point (17), FIG. 20, at the end of the constant velocity portion on the descending side of the second cam, the clutch disengages and, as indicated by line L, the sector and input gear decelerate to zero velocity with the continued constant velocity travel of the web being solely under the control of the die.

It is to be appreciated that the system can be viewed whereby the zero velocity interval noted between points (9) and (10) on the diagram of FIG. 10 can occur at the second point of zero velocity, point (13), within the scope of the invention.

The overlapping of the positive feed roll feeding of the web with the die feeding of the web, at a constant velocity, is significant in that this enables a release of the die from the web, as well as a die engagement of the web at or during the constant velocity feeding of the webs in the forward direction by the feed rollers without affecting web movement. The maintenance of these short durations of constant forward velocity are significant in enabling the system to be adjusted to zero scrap, or for that matter even negative scrap if so desired.

It is particularly significant that the system herein has the ability to produce blanks or patterns with an interrupted or two-pass cut. This ability arises from the fact that the apparatus can be adjusted to obtain an underfeed or "net pullback" to compensate exactly for the fact that the die tends to overfeed or feed a length of paper greater than the length of the periphery of the die itself. The clutch of the system engages and disengages the feed rolls during periods of constant velocity at die speed. As such, the clutch can engage or disengage without affecting the motion of the web. This is contrasted to Bishop, 3,756,149 wherein the feed rolls must close exactly at the instant the nip releases the web and must open at the instant the nip engages the web. As such, if the timing is not perfect the web will be under the simultaneous control of both the nip and the feed rolls when they are necessarily moving at different speeds due to the cam velocity profile, in Bishop, being other than constant velocity at this time. Accuracy under the Bishop system further suffers due to the fact that the web is required to accelerate the top feed roll up to web speed as the feed rolls close, and slippage and loss of accuracy is the inevitable result. In the system of the present invention, the feed rolls are always in contact with the web.

I claim:

1. System for eliminating the untreated portions of a web while producing a series of treated areas along the length of the web for the purpose of eliminating waste between treated areas and permitting the two-stage treatment of areas during successive revolutions of the treatment rolls, comprising a pair of parallel treatment rolls carrying treatment means operative at the aligned centerlines of the rolls to effect treatment, said treatment means including a trailing edge and a leading edge, said treatment means gripping and forwardly propelling the web, at the peripheral velocity of the rolls, while effecting treatment, a pair of feed rolls between which the web passes, the feed rolls in synchronization with the treatment means, traveling under the propulsion of the web when the web is engaged by the treatment means and controlling the travel of the web when the web is released by the treatment means, feed roll drive means for producing relative forward and reverse movement of the feed rolls independently of the web propulsion thereof, said drive means serving to drive at least one of the feed rolls through a cycle at a peripheral velocity equal to the propelled velocity of the web imparted thereto by the treatment rolls in the forward direction of movement of the web for a first adjustable distance from a point prior to alignment of the trailing edge of the treatment means with the aligned rolls' centerlines to an adjustable point beyond the aligned centerlines corresponding to a point at or beyond disengagement of the trailing edge of the treatment means from the web, and for a second adjustable distance from a point at or prior to engagement of the leading edge of the treatment means, prior to the aligned centerline of the rolls, to a point beyond the aligned centerlines, and, between disengagement of the trailing edge from the web and engagement of the leading edge with the web, drives the feed rolls in a reverse direction at a velocity equal to the forward velocity of the web for a third distance at least as great as the combined first and second distances.

2. System for eliminating the untreated portions of a web while producing a series of treated areas along the length of the web for the purpose of eliminating waste between treated areas and permitting the two-stage treatment of areas during successive revolutions of the treatment rolls, comprising a pair of parallel treatment rolls carrying treatment means operative at the aligned centerlines of the rolls to effect treatment, said treatment means including a trailing edge and a leading edge, said treatment means gripping and forwardly propelling the web, at the peripheral velocity of the rolls, while effecting treatment, a pair of feed rolls between which the web passes, the feed rolls in synchronization with the treatment means, traveling under the propulsion of the web when the web is engaged by the treatment means and controlling the travel of the web when the web is released by the treatment means, feed roll drive means for producing relative forward and reverse movement of the feed rolls independently of the web propulsion thereof, said drive means serving to drive at least one of the feed rolls through a cycle at a peripheral velocity equal to the propelled velocity of the web imparted thereto by the treatment rolls in the forward direction of movement of the web for a first adjustable distance from a point prior to alignment of the trailing edge of the treatment means with the aligned rolls' centerlines to an adjustable point beyond the aligned centerlines corresponding to a point at or beyond disengagement of the trailing edge of the treatment means from the web, and for a second adjustable distance from a point at or prior to engagement of the leading edge of the treatment means, prior to the aligned centerline of the rolls, to a point beyond the aligned centerlines, and, between disengagement of the trailing edge from the web and engagement of the leading edge with the web, drives the feed rolls in a reverse direction for a third distance at least as great as the combined first and second distances.

3. A method for eliminating the untreated portions of a web while producing a series of treated areas along the length of the web in rotary treatment apparatus including a pair of parallel treatment rolls carrying treatment means which, at the aligned centerlines of the rolls, effect treatment of the web, the treatment means including a trailing edge and a leading edge with the treatment means gripping and forwardly propelling the web, at the peripheral velocity of the rolls, while engaged therewith, the feed rolls for controlling movement of the web in synchronization with the treatment rolls when the web is engaged by the treatment means, and independently of the treatment rolls when the web is released from the treatment means; said method comprising driving the web engaged feed rolls at a constant peripheral forward velocity equal to the constant velocity of the treatment roll-propelled web for a first adjustable period as the trailing edge of the treatment means moves from a point prior to the aligned centerlines of the rolls to a point at or beyond traling edge release of the web beyond the aligned centerlines, decelerating the feed rolls, and web controlled thereby, at a first predetermined rate of deceleration to zero velocity, maintaining zero velocity for a period relating to the distance between the trailing and leading edges of the treatment means, accelerating the feed rolls and web in a reverse direction at a rate equal to the first rate of deceleration to a constant reverse velocity equal to the constant forward velocity of the treatment roll-propelled web, maintaining the constant reverse velocity for a second period, decelerating the feed rolls and web at a second predetermined rate of deceleration to zero velocity, at zero velocity accelerating the feed rolls and web in a forward direction to a constant forward velocity equal to the treatment rolls-propelled constant velocity of the web, and maintaining the constant forward velocity of the feed rolls for a third adjustable period from before leading edge engagement and extending to a point whereat the leading edge has moved beyond the centerlines, said second period being at least equal to the combined first and third adjustable periods.

4. A method for eliminating the untreated portions of a web while producing a series of treated areas along the length of the web in rotary treatment apparatus including a pair of parallel treatment rolls carrying treatment means which, at the aligned centerlines of the rolls, effect treatment of the web, the treatment means including a trailing edge and a leading edge with the treatment means gripping and forwardly propelling the web, at the peripheral velocity of the rolls, while engaged therewith, and feed rolls for controlling movement of the web in synchronization with the treatment rolls when the web is engaged by the treatment means, and independently of the treatment rolls when the web is released from the treatment means; said method comprising driving the web engaged feed rolls at a constant peripheral forward velocity equal to the constant velocity of the treatment roll-propelled web for a first period as the trailing edge of the treatment means moves from a point prior to the aligned centerlines of the rolls to the point of trailing edge release of the web beyond the aligned centerlines, decelerating the feed rolls, and web controlled thereby, at a first rate of deceleration to zero velocity, accelerating the feed rolls and web in a reverse direction, maintaining the reverse motion for a second period, decelerating the feed rolls and web to zero velocity, at zero velocity accelerating the feed rolls and web in a forward direction to a constant forward velocity equal to the treatment rolls-propelled constant velocity of the web, and maintaining the constant forward velocity of the feed rolls for a third period during which the leading edge is engaged and equal to movement of the leading edge a distance beyond the aligned centerlines of the rolls, said second period being at least equal to the combined first and third periods.

5. The method of claim 4, including maintaining zero velocity, at one of the points of zero velocity of the feed rolls, for a period relating to the distance between the trailing and leading edges of the treatment means.

6. Apparatus for eliminating the untreated portions of a web while producing a series of treated areas along the length of the web for the purpose of eliminating waste between treated areas and permitting the two-stage treatment of areas during successive revolutions of the treatment rolls, comprising a pair of parallel treatment rolls carrying treatment means operative at the aligned centerlines of the rolls to effect treatment, said treatment means including a trailing edge and a leading edge, said treatment means being operable to grip and forwardly propel the web, at the peripheral velocity of the rolls, while effecting treatment, feed roll means between which the web passes, said feed roll means traveling freely under the propulsion of the web, when the web is engaged and propelled by the treatment means, for the major extent of the treatment means between the leading and trailing edge thereof, said feed roll means controlling the travel of the web upon release of the web by the treatment means, feed roll drive means for producing relative forward and reverse movement of the feed roll means independently of the web propulsion thereof, said drive means serving to drive the feed roll means through a cycle in the forward direction of movement of the web for a first distance from a point prior to alignment of the trailing edge of the treatment means with the aligned rolls' centerline to a point beyond alignment of the trailing edge with the aligned centerlines, the trailing edge of the treatment means disengaging from the web at an intermediate point during this forward movement, and for a second distance in a forward direction from a point prior to the leading edge of the treatment means aligning with the centerline of the rolls, to a point beyond alignment of the leading edge with the aligned centerlines, during which the leading edge engages with the web, said drive means, between the driving of the feed roll means the first distance in the forward direction and the driving of the feed roll means the second distance in the forward direction serving to drive the feed roll means in a reverse direction for a third distance relating to the combined first and second distances.

* * * * *